United States Patent [19]

Kishimoto et al.

[11] 4,446,225

[45] May 1, 1984

[54] METHOD FOR PROCESSING COLOR PHOTOGRAPHIC LIGHT-SENSITIVE MATERIAL

[75] Inventors: Shinzo Kishimoto; Kiyohiko Yamamuro, both of Kanagawa, Japan

[73] Assignee: Fuji Photo Film Co., Ltd., Kanagawa, Japan

[21] Appl. No.: 478,942

[22] Filed: Mar. 25, 1983

[30] Foreign Application Priority Data

Mar. 25, 1982 [JP] Japan ..... 57-47821

[51] Int. Cl.[3] ..... G03C 7/00

[52] U.S. Cl. ..... 430/393; 430/430; 430/460; 430/461

[58] Field of Search ..... 430/393, 430, 431, 460, 430/455, 461

[56] References Cited

U.S. PATENT DOCUMENTS

| | | | |
|---|---|---|---|
| 3,042,520 | 7/1962 | Johnson | 430/461 |
| 3,241,966 | 3/1966 | Heilmann et al. | 430/461 |
| 3,772,020 | 11/1973 | Smith | 430/393 |
| 3,809,563 | 5/1974 | Nimura et al. | 430/393 |
| 4,144,068 | 3/1979 | Ishibashi et al. | 430/393 |
| 4,242,442 | 12/1980 | Idota et al. | 430/393 |
| 4,322,493 | 3/1982 | Shibaoka et al. | 430/461 |

*Primary Examiner*—J. Travis Brown

*Attorney, Agent, or Firm*—Sughrue, Mion, Zinn, Macpeak & Seas

[57] ABSTRACT

A method for processing a color photographic light-sensitive material is disclosed. The process envolves providing an exposed silver halide color photographic light-sensitive material and subjecting the material to a color development processing. During the processing after development processing the material is brought into contact with a compound represented by the general formulae (I-a) or (I-b) in a bath of a bleaching or bleach-fixing processing or in a pre-bath thereof.

(I-a)

(I-b)

wherein A represents an amino group which is optionally substituted or a nitrogen-containing hetero ring residue which may be optionally substituted, $R^1$ represents a hydrogen atom or a carboxy group, $R^2$ represents a monovalent metal atom, an ammonium group, an optionally substituted alkyl group or a group represented by $R^3$ and $R^4$ each represents a hydrogen atom or an alkyl group which may be substituted by a hydroxy group, an alkoxy group, a halogen atom, a carboxyl group, $—SO_2H$, $—SO_3H$, or a group represented by A described above, m represents 1 or 2, and n represents an integer of 2 to 4. The method of the invention does not produce poisonous materials which are harmful to the environment and provides an excellent high speed bleaching process without harming other photographic properties.

6 Claims, No Drawings

METHOD FOR PROCESSING COLOR PHOTOGRAPHIC LIGHT-SENSITIVE MATERIAL

FIELD OF THE INVENTION

The present invention relates to the processing of an exposed silver halide color photographic light-sensitive material (hereinafter referred to as a color light-sensitive material) which comprises developing, bleaching, and fixing it (hereinafter referred to as a color photograhic processing), and, more particularly, to a bleaching process which accelerates the bleaching thus shortening the processing time while providing sufficient bleaching, thus providing a color photographic image having good image quality.

BACKGROUND OF THE INVENTION

Fundamental steps of processing color light-sensitive materials generally include a color-developing step and a silver-removing step. That is, an exposed silver halide color photographic light-sensitive material is introduced into a color-developing step, wherein silver halide is reduced with a color-developing agent to produce silver and the oxidized color developing agent in turn reacts with a color former to give a dye image. Subsequently, the color photographic material is introduced into a silver-removing step, wherein silver having been produced in the preceding step is oxidized with an oxidizing agent (usually called a bleaching agent), and dissolved away with a silver ion-complexing agent usually called a fixing agent. Therefore, only a dye image is formed in the thus processed photographic material. In addition to the above-described two fundamental steps of color development and silver removal, actual development processing involves auxiliary steps for maintaining the photographic and physical quality of the resulting image or for improving the preservability of the image. For example, there are illustrated a hardening bath for preventing a light-sensitive layer from being excessively softened during photographic processing, a stopping bath for effectively stopping a developing reaction, an image-stabilizing bath for stabilizing the image, and a membrane-removing bath for removing the backing layer of the support.

The above-described silver removal may be conducted in two ways: one way uses two steps employing a bleaching bath and a fixing bath; and the other way is more simple and conducted in one step employing a bleach-fixing (or blixing) bath containing both a bleaching agent and a fixing agent for the purpose of accelerating the processing and eliminating work.

Red prussiate and ferric chloride, which have heretofore been used as bleaching agents, are good bleaching agents due to their large oxidizing power. However, a bleaching solution or bleach-fixing solution containing red prussiate can release poisonous cyanide by photolysis causing environmental pollution. Accordingly, the waste processing solution thereof must be made completely harmless in view of environmental pollution. A bleaching solution containing ferric chloride as a bleaching solution is not desirable because materials constituting vessels in which the solution is retained are liable to be corroded due to the extremely low pH and large oxidizing power of the solution. In addition, iron hydroxide is precipitated in an emulsion layer during the water-washing step provided after the bleaching step, resulting in stain formation.

On the other hand, potassium dichromate, quinones, copper salts, etc., which have been used as bleaching agents have weak oxidizing power and are difficult to handle.

In recent years, bleach processing using a ferric ion complex salt (e.g., aminopolycarboxylic acid-ferric ion complex salt, particularly iron (III) ethylenediaminetetraacetate complex salt) as a major component has mainly been employed in processing color photographic light-sensitive materials in view of acceleration and simplification of the bleaching step and the need to prevent environmental pollution.

However, ferric ion complex salts have a comparatively small oxidizing power and, therefore, have insufficient bleaching power. A bleaching or bleach-fixing solution containing the complex salt as a bleaching agent can attain some desirable objects when bleaching or bleach-fixing a low-speed silver halide color photographic light-sensitive material containing, for example, a silver chlorobromide emulsion as a major component. However, such a solution fails to fully remove silver due to insufficient bleaching power or requires a long time to bleach when processing a high-speed, color-sensitized silver halide color photographic light-sensitive material containing a silver chlorobromoiodide emulsion or silver bromoiodide emulsion as a major component, particularly color reversal light-sensitive materials comprising an emulsion containing larger amount of silver for photographic use or color negative light-sensitive materials for photographic use.

Other known bleaching agents than ferric ion complex salts include persulfates. Persulfates are usually used in a bleaching solution together with a chloride. However, this persulfate-containing bleaching solution has less bleaching power than ferric ion complex salts, thus requiring a substantially long period of time for bleaching.

As described above, bleaching agents which do not cause environmental pollution or corrode vessels and apparatuses have only a weak bleaching power. Hence, there has been a need to enhance the bleaching power of a bleaching or bleach-fixing solution containing a bleaching agent with a weak bleaching power, particularly a ferric ion complex salt or a persulfate.

In order to raise the bleaching power of a bleaching or bleach-fixing solution containing a ferric ion complex salt such as iron (III) ethylenediaminetetraacetate as a bleaching agent, it has been proposed to add various bleach accelerating agents to the processing bath.

Examples of such bleach accelerating agents include thiourea derivatives as described in Japanese Patent Publication No. 8506/70, U.S. Pat. No. 3,706,561, etc., selenourea derivatives as described in Japanese Patent Application (OPI) No. 280/71 (the term "OPI" as used herein refers to a "published unexamined Japanese patent application"), five-membered mercapto compounds as described in British Pat. No. 1,138,842, and thiourea derivatives, thiazole derivatives, and thiadiazole derivatives as described in Swiss Patent No. 336,257. However, these bleach-accelerating agents do not show a satisfactory bleach-accelerating effect, or they lack stability in the processing solution. Thus, they provide a processing solution having only a short effective life or which cannot be stored for a long time.

SUMMARY OF THE INVENTION

An object of the present invention is to provide a process for processing a color photographic material, which does not release strongly poisonous materials, which meets the requirement of preventing environmental pollution, and which has excellent bleaching speed.

Another object of the present invention is to provide a process involving a bleaching or bleach-fixing step in which an enhanced bleaching power is attained without deteriorating other photographic properties using a bleaching agent having a weak bleaching power, in particular a ferric ion complex salt or a persulfate.

A further object of the present invention is to provide a bleaching process which uses a bleaching or bleach-fixing solution showing an increased bleaching speed and having good stability.

A still further object of the present invention is to provide a bleaching process which can bleach or bleach-fix a color photographic light-sensitive material having high photographic speed.

These objects of the present invention can be attained by pre-treating an exposed photographic material in a bath containing a compound represented by the following general formula (I-a) or (I-b) before bleaching step or by using a bleaching or bleach-fixing solution containing a compound represented by the general formula (I-a) or (I-b):

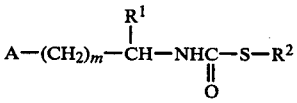

(I-a)

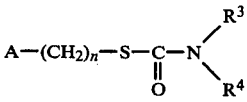

(I-b)

wherein A represents an amino group or a nitrogen-containing hetero ring residue which may be substituted, $R^1$ represents a hydrogen atom or a carboxy group, $R^2$ represents a monovalent metal atom (e.g., sodium, lithium, or potassium), an ammonium group, an optionally substituted alkyl group or a group represented by

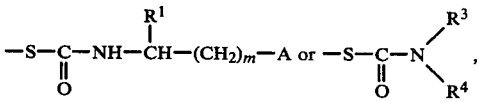

$R^3$ and $R^4$ each represents a hydrogen atom or an alkyl group which may be substituted by a hydroxy group, an alkoxy group (e.g., a methoxy group or an ethoxy group), a halogen atom, a carboxy group, $—SO_2H$, $—SO_3H$ or the group represented by A described above, m represents 1 or 2, and n represents an integer of 2 to 4, with 2 or 3 being preferable.

DETAILED DESCRIPTION OF PREFERRED EMBODIMENTS

A substituent for the amino group represented by A is preferably an alkyl group containing 1 to 3 carbon atoms, which may be substituted by a hydroxy group, a methoxy group, or an ethoxy group. The amino group represented by A may be substituted by one or two alkyl groups. A nitrogen-containing hetero ring represented by A is a 5- or 6-membered hetero ring containing N, O or S. Specific examples thereof include saturated hetero rings such as pyrrolidine, piperidine, piperazine and morpholine and unsaturated hetero rings such as imidazole, triazole and indole. These hetero rings may be substituted by an alkyl group containing 1 to 3 carbon atoms and being optionally substituted by a hydroxy group, a methoxy group or an ethoxy group.

As the alkyl groups represented by $R^2$, $R^3$ and $R^4$, those which contain 1 to 5 carbon atoms are preferable; specific examples thereof include a methyl group, an ethyl group, and a propyl group. Examples of the substituents for the alkyl group include halogen, hydroxy, alkoxy, carboxy, $—SO_3H$, $—SO_2H$, etc. Examples of the substituted alkyl group represented by $R^2$, $R^3$ or $R^4$ include $—CH_2Cl$, $—CH_2CH_2OH$, $—CH_2CH_2OCH_3$, $—CH_2CH_2OC_2H_5$,

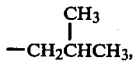

$—CH_2COOH$, $—CH_2CH_2COOH$, $—CH_2CH_2COOH$, $—CH_2SO_3H$, $—CH_2CH_2SO_3H$, $—CH_2CH_2CH_2SO_3H$, $—(CH_2)_4SO_3H$, $—CH_2SO_2H$, $—CH_2CH_2SO_2H$, $—(CH_2)_3SO_2H$, and $—(CH_2)_4SO_2H$. Further, the substituted alkyl group may be $—CH_2CH_2—A$, $—(CH_2)_3—A$,

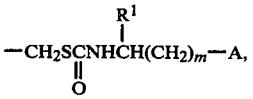

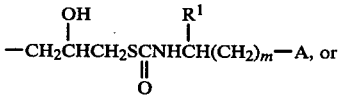

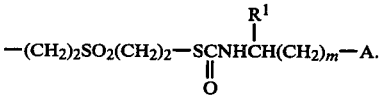

Specific examples of preferred compounds are illustrated below.

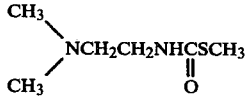

(I-a)-(1)

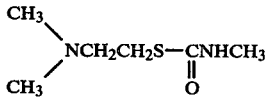

(I-b)-(2)

-continued
(I-b)-(3)
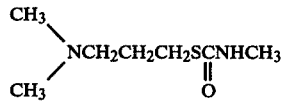
(I-a)-(4)
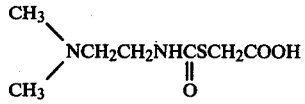
(I-a)-(5)
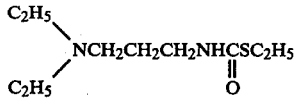
(I-a)-(6)
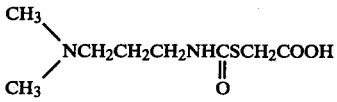
(I-a)-(7)
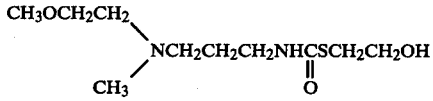
(I-a)-(8)
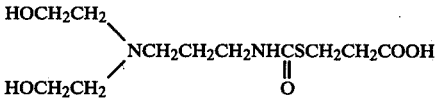
(I-a)-(9)
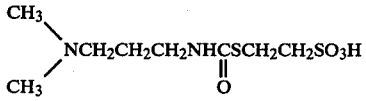
(I-a)-(10)
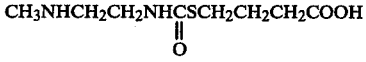
(I-a)-(11)
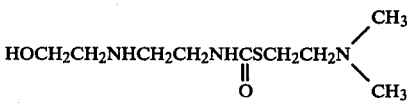
(I-a)-(12)
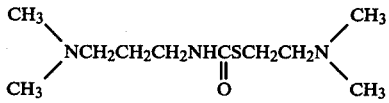
(I-a)-(13)
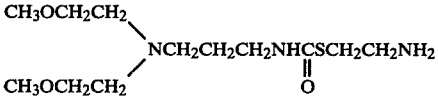
(I-a)-(14)
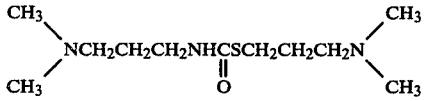
(I-a)-(15)
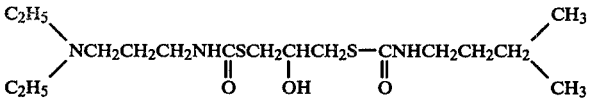
(I-b)-(16)
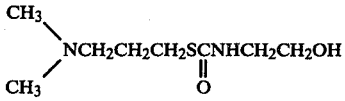
(I-b)-(17)
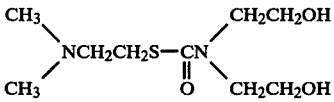

-continued
(I-a)-(18)
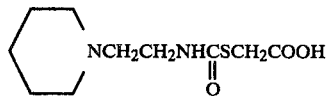
(I-a)-(19)
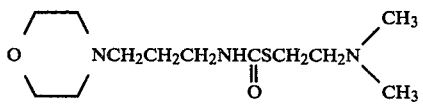
(I-a)-(20)
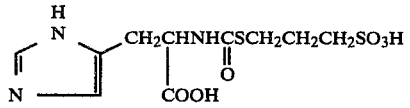
(I-a)-(21)
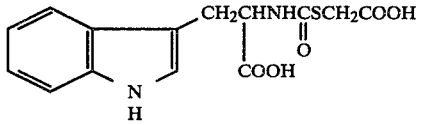
(I-a)-(22)
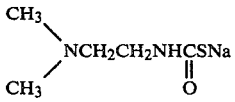
(I-a)-(23)
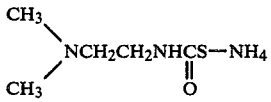
(I-a)-(24)
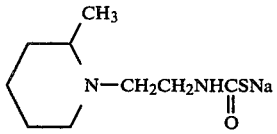
(I-a)-(25)
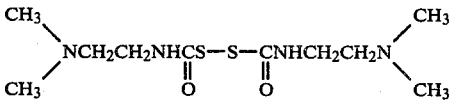
(I-a)-(26)
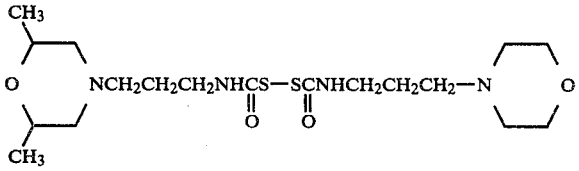
(I-a)-(27)
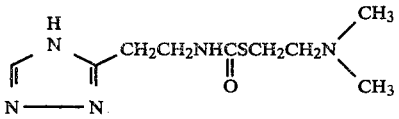
(I-a)-(28)
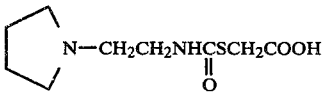
(I-a)-(29)
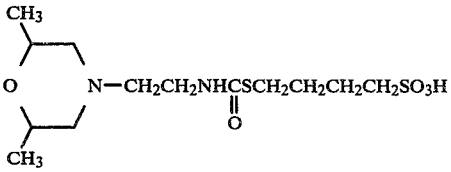

-continued (I-a)-(30)

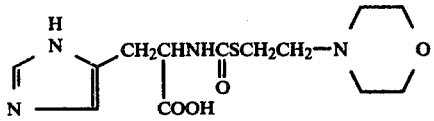

The compounds of the present invention are synthesized by, for example, the process shown below.

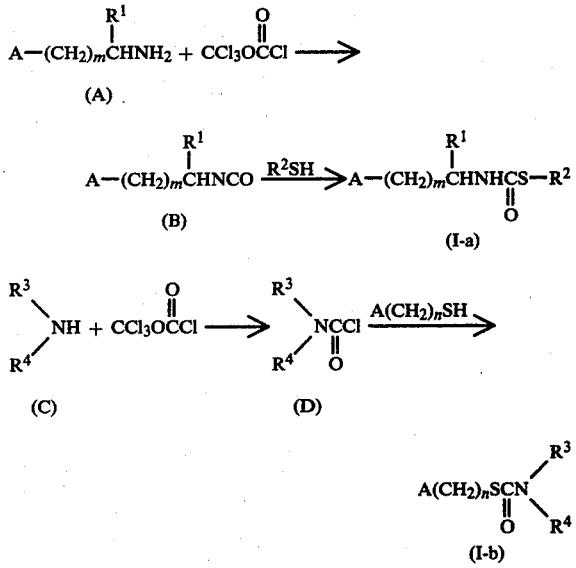

wherein A, $R^1$, $R^2$, $R^3$, $R^4$, m and n are the same as defined with respect to the general formulae (I-a) and (I-b).

Compounds of general formula (I-a) can be easily obtained by reacting an isocyanate (B), which is obtained by the reaction between an amino compound (A) dissolved in dichloromethane or THF (Tetrahydrofuran) and phosgene dimer [TCF (Trichloromethyl chloroformate)], with an alkylmercaptan, $R^2SH$.

Compounds of general formula (I-b) can also be easily synthesized by reacting a carbamoyl chloride (D), which is obtained by the reaction between an amine (C) and TCF, with an aminoalkylmercaptan or a nitrogen-containing hetero ring-substituted alkylmercaptan, $A—(CH_2)_nSH$.

The compound of the foregoing general formula to be used in the present invention as a bleach-accelerating agent may be incorporated in a bleaching bath, a bleach-fixing bath, or a pre-bath thereof, or may be incorporated in both a bleaching or bleach-fixing bath and a pre-bath thereof. The amount of the compound of the present invention to be added to these solutions varies depending upon the kind of processing solution, kind of photographic material to be processed, processing temperature, time necessary for conducting intended processing. However, an amount of $1\times10^{-5}$ to 1 mol per liter of a processing solution is suitable, with $1\times10^{-3}$ to $1\times10^{-1}$ mol being preferable. In general, however, when the amount added is small, there results a small bleach-accelerating effect, whereas when the amount is more than is necessary, a precipitate is formed which stains processed materials. Therefore, the best range is properly determined with consideration for individual cases.

The compound of the present invention is generally added to a processing solution by previously dissolving it in water, alkali, organic acid, or the like. If necessary, an organic solvent may be used for dissolving the compound without adversely affecting its bleach-accelerating effect.

When incorporating the compound of the present invention in a pre-bath of a bleaching solution or bleach-fixing solution, the pre-bath may have various compositions. A pre-bath having the simplest composition is an aqueous solution prepared by merely dissolving the compound of the present invention in water. Aqueous solutions properly containing acids such as acetic acid, boric acid, etc., alkalis such as sodium hydroxide, etc., or salts such as sodium sulfite, sodium acetate, sodium thiosulfate, sodium borate, sodium carbonate, sodium bicarbonate, etc., are also usable as pre-baths with advantage. Pre-baths having any pH may be used with satisfactory effects on the present invention. However, too high of a pH can generate stain, and hence pre-baths having a pH of 9 or less are generally preferable. The pre-bath may further contain, if necessary, precipitation-preventing agents comprising various chelate compounds, hardeners comprising various compounds including alums or aldehydes, pH buffers, halide salt-fixing agents, antioxidants such as sulfites, hydroxylamine, hydrazine, etc., swelling-preventing agents such as sodium sulfate, magnesium sulfate, etc., surfactants, and the like.

Between the pre-bath and the bleaching or bleach-fixing bath may be provided, for example, a water-washing step, stopping step, stop-fixing step, or the like. In such cases, the addition of the compound of the present invention to the pre-bath will also bring about the same bleach-accelerating effect. However, where the compound of the present invention is incorporated only in the pre-bath, the pre-bath is preferably provided immediately before a bleaching or bleach-fixing bath.

In the bleaching solution or bleach-fixing solution of the present invention, a bleaching agent with weak bleaching power is used. A ferric ion complex, one of the bleaching agents, is a complex of ferric ion and a chelating agent such as aminopolycarboxylic acid, aminopolyphosphoric acid or the salt thereof. Aminopolycarboxylic acid salts or aminopolyphosphoric acid salts are alkali metal salts, ammonium salts or water-soluble amine salts thereof. The alkali metals include sodium, potassium, lithium, etc., and water-soluble amines include alkylamines (e.g., methylamine, diethylamine, triethylamine, butylamine, etc.), cyclic amines (e.g., cyclohexylamine), arylamines (e.g., aniline, m-toluidine, etc.), and hetero ring amines (e.g., pyridine, morpholine, piperidine etc.).

Typical examples of the chelating agent of these aminopolycarboxylic acids, aminopolyphosphoric acids, and the salts thereof are:

Ethylenediaminetetraacetic acid;
Disodium ethylenediaminetetraacetate;
Diammonium ethylenediaminetetraacetate;

Tetra(trimethylammonium) ethylenediaminetetraacetate;
Tetrapotassium ethylenediaminetetraacetate;
Tetrasodium ethylenediaminetetraacetate;
Trisodium ethylenediaminetetraacetate;
Diethylenetriaminepentaacetic acid;
Pentasodium diethylenetriaminepentaacetate;
Ethylenediamine-N-(β-hydroxyethyl)-N,N',N'-triacetic acid;
Trisodium ethylenediamine-N-(β-hydroxyethyl)-N,N',N'-triacetate;
Triammonium ethylenediamine-N-(β-hydroxyethyl)-N,N',N'-triacetate;
Propylenediaminetetraacetic acid;
Disodium propylenediaminetetraacetate;
Nitrilotriacetic acid;
Trisodium nitrilotriacetate;
Cyclohexanediaminetetraacetic acid;
Disodium cyclohexanediaminetetraacetate;
Iminodiacetic acid;
Dihydroxyethylglycine;
Ethyl ether diaminetetraacetic acid;
Glycol ether diaminetetraacetic acid;
Ethylenediaminetetrapropionic acid;
Phenylenediaminetetraacetic acid;
1,3-Diaminopropanol-N,N,N',N'-tetramethylenephosphonic acid;
Ethylenediamine-N,N,N',N'-tetramethylenephosphonic acid;
1,3-Propylenediamine-N,N,N',N'-tetramethylenephosphonic acid; etc.

The present invention is not limited to the above-illustrated chelating agents.

The ferric ion complex salts may be used in the form of complex salt or may be formed in situ in a solution by using a ferric salt (e.g., ferric sulfate, ferric chloride, ferric nitrate, ferric ammonium sulfate or ferric phosphate) and a chelating agent (e.g., aminopolycarboxylic acid, aminopolyphosphonic acid or phosphonocarboxylic acid). When they are used in the form of a complex salt, they may be used alone or in combination of two or more. On the other hand, where a complex is formed in situ in a solution by using a ferric salt and a chelating agent, one, two or more ferric salts may be used. Further, one, two or more chelating agents may also be used. In every case, a chelating agent may be used in an amount more than is necessary for forming a ferric ion complex salt.

A bleaching or bleach-fixing solution containing the above-described ferric ion complex may further contain complexes of other metals than iron such as cobalt or copper or hydrogen peroxide.

Persulfates to be used in the bleaching or bleach-fixing solution of the present invention are alkali metal persulfates such as potassium persulfate, sodium persulfate, etc., and ammonium persulfate. The bleach accelerating agents of the present invention are, of course, effective for the persulfates, but show particularly remarkable effects on ferric ion complex salts.

The bleaching solution of the present invention can contain re-halogenating agents such as bromides (e.g., potassium bromide, sodium bromide, ammonium bromide, etc.), chlorides (e.g., potassium chloride, sodium chloride, ammonium chloride, etc.), and the like in addition to the bleaching agents such as ferric ion complex salts and the above-described compounds. Further, additives which have a pH-buffering ability and which are known to be used in ordinary bleaching solutions, such as inorganic acids, organic acids, and the salts thereof (e.g., boric acid, borax, sodium metaborate, acetic acid, sodium acetate, sodium carbonate, potassium carbonate, phosphorous acid, phosphoric acid, sodium phosphate, citric acid, sodium citrate, tartaric acid, etc.) may be added.

The amount of bleaching agent is 0.1 to 2 mols per liter of the bleaching solution, and the pH of the bleaching solution is desirably 3.0 to 8.0, particularly 4.0 to 7.0, when a ferric ion complex salt is used, and desirably 1.0 to 7.0, particularly 1.5 to 3.0, when a persulfate is used.

On the other hand, in processing the present invention, as a bleach-fixing agent, ordinary fixing agents, i.e., water-soluble, silver halide-dissolving agents such as thiosulfates (e.g., sodium thiosulfate, ammonium thiosulfate, ammonium sodium thiosulfate, potassium thiosulfate, etc.); thiocyanates (e.g., sodium thiocyanate, ammonium thiocyanate, potassium thiocyanate, etc.); thioether compounds (e.g., ethylenebisthioglycolic acid, 3,6-dithia-1,8-octanediol, etc.); and thioureas may be used alone or in a combination of two or more. In addition, special bleach-fixing agents comprising a combination of a fixing agent described in Japanese Patent Application (OPI) No. 155354/80 and a large amount of a halide compound such as potassium iodide can be used as well.

In the bleach-fixing composition, the ferric ion complex salt is present in an amount of 0.1 to 2 mols and the amount of fixing agent is 0.2 to 4 mols, per liter of the bleach-fixing solution.

A bleach-fixing solution can contain the aforesaid additives to be added to the bleaching solution and preservatives such as sulfites (e.g., sodium sulfite, potassium sulfite, ammonium sulfite, etc.), hydroxylamine, hydrazine, aldehyde-bisulfite adducts (e.g., acetaldehydesodium bisulfite adduct), etc. Further, various fluorescent brightening agents, defoaming agents, surfactants, organic solvents (e.g., methanol), and known blix-accelerating agents (e.g., polyamine compounds described in Japanese Patent Publication No. 8836/70, thiourea derivatives described in Japanese Patent Publication No. 8506/70, iodides described in German Pat. No. 1,127,715, polyethylene oxides described in German Pat. No. 966,410, nitrogen-containing hetero ring compounds described in German Pat. No. 1,290,812, and other thioureas) may be used. The pH of the bleach-fixing solution upon use is usually 4.0 to 9.0, particularly preferably 5.0 to 8.0.

Primary aromatic amine color developing agents to be used in the present invention in a color-developing solution include a wide range of known ones for use in various color photographic processes. The developing agents include aminophenol derivatives and p-phenylenediamine derivatives. These compounds are generally used in the form of salts such as hydrochlorides or sulfates rather than in free form in view of stability. They are generally used in an amount of about 0.1 g to about 30 g, more preferably about 1 g to about 15 g, per liter of color-developing solution.

The aminophenol type developing agents include, for example, o-aminophenol, p-aminophenol, 5-amino-2-hydroxytoluene, 2-amino-3-hydroxytoluene, 2-hydroxy-3-amino-1,4-dimethylbenzene, etc.

Particularly useful primary aromatic amine type color-developing agents are N,N-dialkyl-p-phenylenediamine compounds wherein the alkyl group and the phenyl group may or may not be substituted. Of these, particularly useful compounds are N,N-diethyl-p-phenylenediamine hydrochloride, N-methyl-p-phenylenediamine hydrochloride, N,N-dimethyl-p-phenylenediamine hydrochloride, 2-amino-5-(N-ethyl-N-dodecylamino)toluene, N-ethyl-N-β-methanesulfonamidoethyl-3-methyl-4-aminoaniline sulfate, N-ethyl-N-β-hydroxyethylaminoaniline, 4-amino-3-methyl-N,N-diethylaniline, 4-amino-N-(2-methoxyethyl)-N-ethyl-3-methylaniline p-toluenesulfonate, etc.

The alkaline color-developing solution to be used in the present invention can optionally contain, in addition to the above-described primary aromatic amine color-developing agent, various ingredients usually added to a color-developing solution, such as alkali agents (e.g., sodium hydroxide, sodium carbonate, potassium carbonate, etc.), alkali metal sulfites, alkali metal bisulfites, alkali metal thiocyanates, alkali metal halides, benzyl alcohol, water-softening agents, thickening agents, etc. The pH of this color-developing solution is usually 7 or above, most generally about 9 to about 13.

The process of the present invention is applicable to color reversal processing. In the present invention, as a black-and-white developing solution to be used in this processing, a black-and-white primary developing solution used for reversal processing of color photographic light-sensitive materials or that to be used for processing black-and-white light-sensitive materials can be used. In addition, various well known additives generally added to a black-and-white developing solution can be incorporated in the solution.

Typical additives include developing agents such as 1-phenyl-3-pyrazolidone, metol, and hydroquinone; preservatives such as sulfites; accelerating agents comprising an alkali such as sodium hydroxide, sodium carbonate, or potassium carbonate; inorganic or organic inhibitors such as potassium bromide, 2-methylbenzimidazole, methylbenzothiazole, etc.; water-softening agents such as polyphosphoric acid salts; and slight amounts of development restrainers comprising an iodide or a mercapto compound.

Silver halide color photographic light-sensitive materials to be processed according to the present invention in the presence of the compound of the present invention are known color photographic light-sensitive materials. The present invention is particularly advantageous for processing coupler-containing multilayer negative color photographic light-sensitive materials or color print photographic light-sensitive materials or for processing color photographic light-sensitive materials designed to be subjected to reversal color processing. In addition, X-ray photographic light-sensitive materials, monolayer special color photographic light-sensitive materials, and color photographic light-sensitive materials containing a black-and-white developing agent such as a 3-pyrazolidone described in U.S. Pat. Nos. 2,751,297, 3,902,905, Japanese Patent Application (OPI) Nos. 64339/81, 85748/81 and 85749/81, and a color developing agent precursor described in U.S. Pat. Nos. 2,478,400, 3,342,597, 3,342,599, 3,719,492, 4,214,047, and Japanese Patent Application (OPI) No. 135628/78 can be processed according to the present invention. Further, the processing may be conducted by allowing a coupler to exist in a developing solution.

In a photographic emulsion layer of color light-sensitive material of the present invention, any of silver bromide, silver bromoiodide, silver chlorobromoiodide, silver chlorobromide, and silver chloride may be used as a silver halide. Silver halide grains in a photographic emulsion are not particularly limited with respect to their mean particle size (particle diameter with respect to spherical or approximately spherical particles, and edge length with cubic particles; presented in terms of an average value based on projected area), with a mean particle size of 3μ or less being preferable. Particle size distribution can be either narrow or broad.

Silver halide particles may be in a regular crystal form such as cubic or octahedral form, in an irregular crystal form such as spherical or platy form, or in a mixed form thereof, or may comprise a mixture of particles different in form.

The silver halide grains may have an inner portion and a surface layer different from, or the same as, each other in phase composition. In addition, silver halide grains of the type forming latent image mainly on the surface thereof and grains of the type forming latent image within them may be used.

The photographic emulsion to be used in the present invention can be prepared by the processes described in P. Glafkides, *Chimie et Physique Photographique* (Paul Montel, 1967), G. F. Duffin, *Photographic Emulsion Chemistry* (The Focal Press, 1966), V. L. Zelikman et al., *Making and Coating Photographic Emulsion* (The Focal Press, 1964), etc. That is, any of an acidic process, a neutral process and an ammoniacal process can be used. As a manner of reacting a soluble silver salt with a soluble halide salt, any of one side-mixing, simultaneous mixing, and their combination may be employed.

A process of forming grains in the presence of excess silver ions (called reverse mixing process) can be employed as well. As one type of the simultaneous mixing, a process called controlled double jet process wherein the pAg in a liquid phase in which silver halide is formed is kept constant can be employed. The process provides a silver halide emulsion containing silver halide grains having a regular crystal form and an approximately uniform particle size.

Two or more silver halide emulsions having been separately prepared may be mixed and used.

During formation or physical ripening of silver halide emulsions, cadmium salts, zinc salts, lead salts, thallium salts, iridium salts or the complex salts thereof, rhodium salts or the complex salts thereof, iron salts or the complex salts thereof, etc., may be allowed to coexist.

In the present invention, both negative emulsions forming surface latent images and direct reversal emulsions can be used. Examples of the latter emulsions include emulsions forming internal latent images and previously fogged direct reversal emulsions.

Examples of useful internal latent image-forming type silver halide emulsions include conversion type emulsions described in U.S. Pat. Nos. 2,592,250, 3,206,313, 3,447,927, 3,761,276 and 3,935,014, core/shell type emulsions, and emulsions containing a foreign metal.

Typical examples of nucleating agents for this type emulsions are hydrazines described in U.S. Pat. Nos. 2,588,982 and 2,563,785; hydrazides and hydrazones described in U.S. Pat. No. 3,227,552; quaternary salt compounds described in British Pat. No. 1,283,835, Japanese Patent Publication No. 38164/74, U.S. Pat. Nos. 3,734,738, 3,719,494, 3,615,615; sensitizing dyes having a nucleating substituent in the dye molecule and described in U.S. Pat. No. 3,718,470; and acylhydrazinophenylthiourea compounds described in U.S. Pat. Nos. 4,030,925 and 4,031,127.

Silver halide emulsions may be used as so-called primitive emulsions without conducting chemical sensitization, but are usually chemically sensitized. Chemical sensitization can be conducted according to the processes described in the aforesaid books by Glafkides or Zelikman et al. or in H. Frieser, *Die Grundlagen der Photographischen Prozesse mit Silberhalogeniden* (Akademische Verlagsgesellschaft, 1968).

That is, sulfur sensitization using sulfur-containing compounds or active gelatin capable of reacting with silver ion, reduction sensitization using a reductive substance, and noble metal sensitization using compounds of noble metals such as gold can be employed alone or in combination. Examples of useful sulfur sensitizers include thiosulfates, thioureas, thiazoles, rhodanines, and other compounds. Specific examples thereof are described in U.S. Pat. Nos. 1,574,944, 2,410,689, 2,278,947, 2,728,668 and 3,656,955. Examples of useful reduction sensitizers include stannous salts, amines, hydrazine derivatives, formamidinesulfonic acids and silane compounds. Specific examples thereof are described in U.S. Pat. Nos. 2,487,850, 2,419,974, 2,518,698, 2,983,609, 2,983,610, 2,694,637, etc. For noble metal sensitization, complexes of the group VIII metals such as platinum, iridium, palladium, etc., can be used as well as gold complexes. Specific examples thereof are described in U.S. Pat. Nos. 2,399,083, 2,448,060, British Pat. No. 618,061, etc.

Photographic emulsions may be spectrally sensitized with methine dyes or the like. Dyes to be used include cyanine dyes, merocyanine dyes, composite cyanine dyes, composite merocyanine dyes, holopolar cyanine dyes, hemicyanine dyes, styryl dyes, and hemioxonol dyes. Particularly useful dyes are those belonging to cyanine dyes, merocyanine dyes, and composite merocyanine dyes.

Useful sensitizing dyes are those described in, for example, German Pat. No. 929,080, U.S. Pat. Nos. 2,231,658, 2,493,748, 2,503,776, 2,519,001, 2,912,329, 3,655,394, 3,656,959, 3,672,897, 3,694,217, British Pat. No. 1,242,588, and Japanese Patent Publication No. 14030/69.

In addition to a silver halide emulsion layer having the above-described light sensitivity may be provided a substantially light-insensitive, fine grain silver halide emulsion layer for the purpose of improving graininess or sharpness or for other purposes. Such substantially light-insensitive fine grain emulsion layer can be provided on the light-sensitive silver halide emulsion layer or between the light-sensitive silver halide emulsion layer and a colloidal silver layer (yellow filter layer or antihalation layer).

The light-sensitive material of the present invention may contain a polyalkylene oxide or its ether, an ester amine derivative, a thioether compound, a thiomorpholine, a quaternary ammonium salt compound, a urethane derivative, a urea derivative, an imidazole derivative, a 3-pyrazolidone, etc., for the purpose of raising sensitivity or contrast or for accelerating development. For example, those described in U.S. Pat. Nos. 2,400,532, 2,423,549, 2,716,062, 3,617,280, 3,772,021, 3,808,003, etc., can be used.

Useful binders for photographic emulsion layers or other constituent layers include gelatin as well as other hydrophilic colloids. For example, proteins such as gelatin derivatives, graft polymers between gelatin and other high polymer, albumin, casein, etc.; cellulose derivatives such as hydroxyethyl cellulose, carboxymethyl cellulose, cellulose sulfate, etc.; sugar derivatives such as sodium alginate, starch derivative, etc.; and various synthetic hydrophilic substances such as homopolymers or copolymers (e.g., polyvinyl alcohol, partially acetallized polyvinyl alcohol, poly-N-vinylpyrrolidone, polyacrylic acid, polymethacrylic acid, polyacrylamide, polyvinyl imidazole, polyvinylpyrazole, etc.) can be used.

Useful gelatins include acid-processed gelatin or enzyme-processed gelatin as described in *Bull Soc. Sci. Phot. Japan,* No. 16, p. 30 (1966) as well as lime-processed gelatin, and a gelatin hydrolyzate or an enzyme-decomposed product. Useful gelatin derivatives include those obtained by reacting gelatin with, for example, acid halides, acid anhydrides, isocyanates, bromoacetic acid, alkanesultones, vinylsulfonamides, maleinimide compounds, polyalkylene oxides and epoxy compounds. Specific examples thereof are described in U.S. Pat. Nos. 2,614,928, 3,132,945, 3,186,846, 3,312,553, British Pat. Nos. 864,414, 1,033,189, 1,005,784, Japanese Patent Publication No. 26845/67, etc.

Useful gelatin graft polymers include high molecular weight grafted products of gelatin prepared by, for example, grafting to gelatin a homo- or copolymer of vinyl monomer such as acrylic acid, methacrylic acid, ester or amide thereof, acrylonitrile and styrene. In particular, graft polymers between gelatin and a polymer having some compatibility with gelatin such as a polymer of acrylic acid, methacrylic acid, acrylamide, methacrylamide, hydroxyalkyl methacrylate or the like are preferable. Examples of these are described in U.S. Pat. Nos. 2,763,625, 2,831,767, 2,956,884, etc.

Typical synthetic hydrophilic high molecular substances are described in, for example, West German Patent Application (OLS) No. 2,312,708, U.S. Pat. Nos. 3,620,751, 3,879,205, and Japanese Patent Publication No. 7561/68.

Various compounds may be incorporated in the light-sensitive material of the present invention as antifoggants or stabilizers together with the compound of the present invention represented by the general formula. That is, many compounds known as antifoggants or stabilizers such as azoles (e.g., benzothiazolium salts, nitroindazoles, triazoles, benzotriazoles, benzimidazoles (particularly, nitro- or halogen-substituted derivatives), etc.); hetero ring-containing mercapto compounds (e.g., mercaptothiazoles, mercaptobenzothiazoles, mercaptobenzimidazoles, mercaptothiadiazoles, mercaptotetrazoles (e.g., 1-phenyl-5-mercaptotetrazole), and mercaptopyrimidines); hetero ring-containing mercapto compounds having a water-soluble group such as a carboxyl group or a sulfo group; thioketo compounds (e.g., oxazolinthione); azaindenes (e.g., tetraazaindenes (particularly 4-hydroxy-substituted (1,3,3a,7)-tetraazaindenes); benzenethiosulfonic acids; benzenesulfinic acids; etc., can be added.

More specific examples and ways of using them are described in U.S. Pat. Nos. 3,954,474, 3,982,947, 4,021,248 or Japanese Patent Publication No. 28660/77.

The photographic light-sensitive material of the present invention may contain an organic or inorganic hardener in its photographic emulsion layers or other constituent layers. For example, chromium salts (e.g., chromium alum, chromium acetate, etc.), aldehydes (e.g., formaldehyde, glyoxal, glutaraldehyde, etc.), N-methylol compounds (e.g., dimethylolurea, methyloldimethylhydantoin, etc.), dioxane derivatives (e.g., 2,3-dihydroxydioxane, etc.), active vinyl compounds (e.g., 1,3,5-triacryloyl-hexahydro-s-triazine, 1,3-vinylsulfonyl-2-propanol, etc.), active halides (e.g., 2,4-dichloro-6-hydroxy-s-triazine, etc.), mucohalogenic acids (e.g., mucochloric acid, mucophenoxychloric acid, etc.), etc., can be used alone or in combination.

The photographic light-sensitive material of the present invention may contain in its photographic emulsion layers or other constituent layers various surfactants for various purposes such as improvement of coating properties, antistatic properties, slipping properties, emulsion dispersibility, anti-adhesion properties, and photographic properties (for example, development acceleration, realization of contrasty tone, sensitization, etc.).

For example, there can be used nonionic surfactants such as saponin (steroid type), alkylene oxide derivatives (e.g., polyethylene glycol, polyethylene glycol/-polypropylene glycol condensate, polyethylene glycol alkyl ether or polyethylene glycol alkylaryl ether, polyethylene glycol ether, polyethylene glycol sorbitan ester, polyalkylene glycol alkylamine or amide, silicone polyethylene oxide adduct, etc.), glycidol derivatives (e.g., alkenylsuccinic acid polyglyceride, alkylphenol polyglyceride, etc.), polyhydric alcohol fatty acid esters, sugar alkyl esters, etc.; anionic surfactants having an acidic group such as a carboxy group, a sulfo group, a phospho group, a sulfuric ester group, or a phosphoric ester group (e.g., alkylcarboxylic acid salt, alkylsulfonic acid salt, alkylbenzenesulfonic acid salt, alkylnaphthalenesulfonic acid salt, alkylsulfuric ester, alkylphosphoric ester, N-acyl-N-alkyltaurinic acid, sulfosuccinic acid ester, sulfoalkyl polyoxyethylene alkylphenyl ether, polyoxyethylene alkylphosphoric ester, etc.); amphoteric surfactants such as amino acids, aminoalkylsulfonic acids, aminoalkylsulfuric or phosphoric acid esters, alkylbetaines, amine oxides, etc.; and cationic surfactants such as alkylamine salts, aliphatic or aromatic quaternary ammonium salts, hetero ring quaternary ammonium salts (e.g., pyridinium, imidazolium, etc.), and phosphonium or sulfonium salts of aliphatic series or containing a hetero ring.

The light-sensitive material of the present invention contains in its photographic emulsion layers color-forming couplers capable of forming color by oxidative coupling with an aromatic primary amine developing agent (for example, a phenylenediamine derivative or an aminophenol derivative) in color development processing. For example, magenta coupler include 5-pyrazolone coupler, pyrazolobenzimidazole coupler, cyanoacetylcoumarone coupler, open-chain acylacetonitrile coupler, etc., yellow couplers include acylacetamide couplers (e.g., benzoylacetanilides, pivaloylacetanilides, etc.), and cyan couplers include naphthol couplers, phenol couplers, etc. Of these couplers, nondiffusible couplers having a hydrophobic group called ballast group are desirable. The couplers may be of either 4-equivalent type or 2-equivalent type. Colored couplers having color-correcting effect or couplers capable of releasing a development inhibitor upon development (call DIR couplers) may also be used. In addition to DIR couplers, DIR coupling compounds capable of forming a colorless coupling reaction product and releasing a development inhibitor and DIR redox compounds may also be incorporated.

Specific examples of magenta color-forming couplers are described in U.S. Pat. Nos. 2,600,788, 2,983,608, 3,062,653, 3,127,269, 3,311,476, 3,419,391, 3,519,429, 3,558,319, 3,582,322, 3,615,506, 3,834,908, 3,891,445, West German Patent No. 1,810,464, West German Patent Application (OLS) Nos. 2,408,665, 2,417,945, 2,418,959, 2,424,467, Japanese Patent Publication No. 6031/65, Japanese Patent Application (OPI) Nos. 20826/76, 13041/65, 58922/77, 129538/74, 74027/74, 159336/75, 42121/77, 74028/74, 60233/75, 26541/76, 55122/78, etc.

Specific examples of yellow color-forming couplers are described in U.S. Pat. Nos. 2,875,057, 3,265,506, 3,408,194, 3,551,155, 3,582,322, 3,725,072, 3,891,445, West German Patent No. 1,547,868, West German Patent Application (OLS) Nos. 2,219,917, 2,261,361, 2,414,006, British Pat. No. 1,425,020, Japanese Patent Publication No. 10783/76, Japanese Patent Application (OPI) Nos. 26133/72, 73147/73, 102636/76, 6341/75, 123342/75, 130442/75, 21827/76, 87650/75, 82424/77, 115219/77, etc.

Specific examples of cyan couplers are described in U.S. Pat. Nos. 2,369,929, 2,434,272, 2,474,293, 2,521,908, 2,895,826, 3,034,892, 3,311,476, 3,458,315, 3,476,563, 3,583,971, 3,591,383, 3,767,411, 4,004,929, West German Patent Application (OLS) Nos. 2,414,830, 2,454,329, Japanese Patent Application (OPI) Nos. 59838/73, 26034/76, 5055/73, 146828/76, 69624/77, and 90932/77.

Useful colored couplers are described in U.S. Pat. Nos. 3,476,560, 2,521,908, 3,034,892, Japanese Patent Publication Nos. 2016/69, 22335/63, 11304/67, 32461/49, Japanese Patent Application (OPI) Nos. 26034/76, 42121/77 and West German Patent Application (OLS) No. 2,418,959.

Useful DIR couplers include o-aminoazo type DIR couplers described in U.S. Pat. No. 3,148,062, thioether type DIR couplers described in U.S. Pat. No. 3,227,554, 2-benzotriazole type DIR couplers described in U.S. Pat. No. 3,617,291, 1-benzotriazolyl type DIR couplers described in West German Patent Application (OLS) No. 2,414,006, Japanese Patent Application (OPI) Nos. 82424/77 and 117627/77, nitrogen-containing hetero ring-substituted acetic acid ester type DIR couplers described in Japanese Patent Application (OPI) Nos. 30591/75 and 82423/77, 2-equivalent type DIR cyan couplers described in West German Patent Application (OLS) No. 2,527,652, Japanese Patent Application Nos. 90932/77 and 146828/76, malonic acid diamide type DIR couplers described in Japanese Patent Application (OPI) No. 69624/77, and the like.

DIR coupling compounds which do not form a color include thioether type cyclic DIR compounds not forming a color and described in British Pat. No. 1,423,588, West German Patent Application (OLS) Nos. 2,405,442, 2,523,705, 2,529,350, 2,448,063, U.S. Pat. No. 3,938,996, thioether type chain form DIR compounds not forming a color and described in U.S. Pat. Nos. 3,632,345 and 3,928,041, benzotriazolyl type DIR compounds not forming a color and described in Japanese Patent Application (OPI) Nos. 147716/75, 105819/76 and 67628/77, picolinium type DIR coupling compounds described in Japanese Patent Application (OPI) No. 72433/76, and the like.

DIR redox compounds include DIR hydroquinones described in U.S. Pat. No. 3,639,417, West German Patent Application (OLS) No. 2,460,202, and U.S. Pat. No. 3,297,445, DIR redox type couplers described in Japanese Patent Application (OPI) No. 57828/77, and the like.

The light-sensitive material of the present invention can contain a developing agent, including those described in *Research Disclosure,* Vol. 176, p. 29 under the item of "Developing agents".

The light-sensitive material prepared by the present invention may contain a dye as a filter dye or for various purposes such as prevention of irradiation. Examples of such dyes include those described in *Research Disclosure,* Vol. 176, pp. 25–26 under the item of "Absorbing and filter dyes".

The light-sensitive material of the present invention can further contain antistatic agents, plasticizers, matting agents, lubricants, ultraviolet ray-absorbing agents, fluorescent brightening agents, air fog-preventing agents, etc.

Silver halide emulsion layers and/or other constituent layers are coated on a support by a procedure such as described in *Research Disclosure,* Vol. 176, pp. 27–28, under the item of "Coating procedures".

In the color photographic processing of the present invention, the use of compound (I-a) or (I-b) having excellent bleach-accelerating effect makes it possible to attain sufficient silver removal in a short processing time even when a bleaching agent with weak bleaching power is used. Compounds (I-a) and (I-b) of the present invention do not adversely affect photographic properties such as color formation, sensitivity, and stain properties. Further, the compounds of the present invention can stably exist in a processing bath for such a long time that troubles with control of the bath can be decreased.

The present invention will now be described in more detail by the following examples of preferred embodiments of the present invention, which, however, are not to be construed as limiting the present invention in any way.

EXAMPLE 1

On an undercoated cellulose triacetate film support were coated, in sequence, the following emulsion solutions to prepare color reversal photographic light-sensitive materials.

First Layer (red-sensitive emulsion layer)

An emulsion solution prepared by adding, to 1,000 g of a silver bromoiodide emulsion (silver iodide: 5 mol%) containing 10 g of silver halide and 5 g of gelatin per 100 g of the emulsion, 500 g of a gelatin solution containing a cyan coupler (C-1) emulsified and dispersed therein (molar ratio of silver to coupler=7:1), 50 cc of a 1% aqueous solution of a stabilizer (A-1), 50 cc of a 1% aqueous solution of coating agent (T-1), and 20 cc of a 2% aqueous solution of hardener (H-1) was coated in a dry thickness of 4μ.

Second Layer (interlayer)

A gelatin solution prepared by adding, to 1,000 g of a 5% gelatin aqueous solution, 100 g of a gelatin aqueous solution containing a stain-preventing agent (A-2) emulsified and dispersed therein, 50 cc of a 1% aqueous solution of coating agent (T-1), and 20 cc of a 2% aqueous solution of hardener (H-1) was coated in a dry thickness of 1μ.

Third Layer (green-sensitive emulsion layer)

An emulsion solution prepared by adding, to 1,000 g of a silver bromoiodide emulsion (silver iodide: 5 mol%) containing 10 g of siver halide and 5 g of gelatin per 100 g of the emulsion, 700 g of a gelatin solution containing magenta coupler (C-2) emulsified and dispersed therein (molar ratio of silver to coupler=7:1), 50 cc of a 1% aqueous solution of stabilizer (A-1), 50 cc of a 1% aqueous solution of coating agent (T-1), and 20 cc of a 2% aqueous solution of hardener (H-1) was coated in a dry thickness of 4μ.

Fourth Layer (yellow filter layer)

A solution prepared by adding 100 cc of a 1% aqueous solution of coating agent (T-1) and 20 cc of a 2% aqueous solution of hardener (H-1) to 1,000 g of a 5% gelatin aqueous solution containing dispersed therein colloidal silver was coated in a silver amount of 0.5 mg/100 cm$^2$.

Fifth Layer (blue-sensitive emulsion layer)

An emulsion solution prepared by adding, to 1,000 g of a silver bromoiodide emulsion (silver iodide: 5 mol%) containing 10 g of silver halide and 5 g of gelatin per 100 g of emulsion, 500 g of a gelatin solution containing emulsified and dispersed therein yellow coupler (C-3) (molar ratio of silver to coupler=7:1), 50 cc of a 1% aqueous solution of stabilizer (A-1), 50 cc of a 1% aqueous solution of coating agent (T-1), and 20 cc of a 2% aqueous solution of hardener (H-1) was coated in a dry thickness of 4μ.

Sixth Layer (protective layer)

A gelatin solution prepared by adding 100 cc of a 1% aqueous solution of coating agent (T-1) and 20 cc of a 1% aqueous solution of hardener (H-1) to a 5% gelatin aqueous solution was coated in a dry thickness of 1μ.

C-1

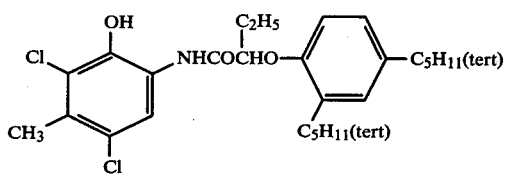

Emulsifying Procedure 75 g of cyan coupler (C-1) was dissolved in a mixture solution of 100 cc of dibutyl phthalate and 200 cc of ethyl acetate, and the resulting solution was emulsified in 600 g of a 10% gelatin aqueous solution together with a dispersing aid.

C-2

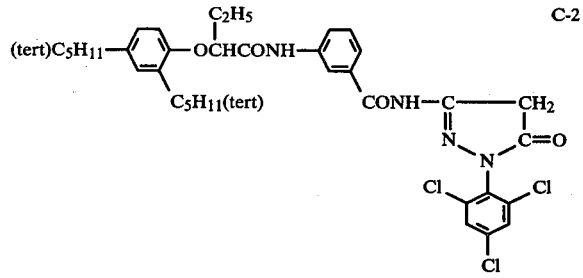

Emulsifying Procedure

Emulsification was conducted in the same manner as with cyan coupler (C-1) except for dissolving 75 g of magenta coupler (C-2) in place of cyan coupler (C-1).

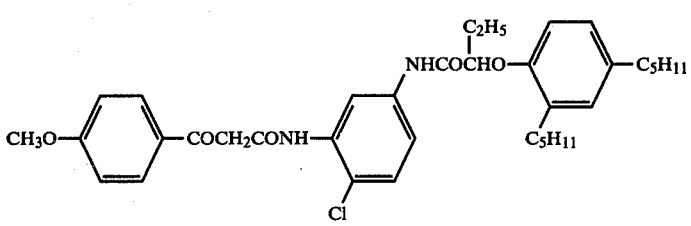

Emulsifying Procedure

Emulsification was conducted in the same manner as with cyan coupler (C-1) except for dissolving 90 g of yellow coupler (C-3) in place of cyan coupler (C-1).

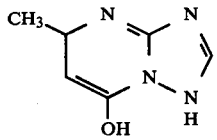

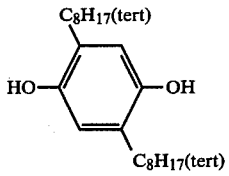

Emulsifying Procedure 100 g of stain-preventing agent (A-2) was dissolved in a mixture solution of 200 cc of dibutyl phthalate and 200 cc of ethyl acetate, and the resulting solution was emulsified in 500 g of a 10% gelatin aqueous solution.

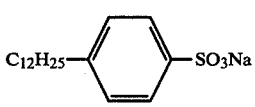

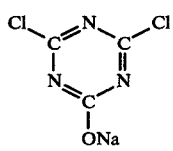

The thus-obtained color reversal film samples were exposed in a properly definite exposure amount to a light emitted from a tungsten light source and filtered to adjust to 4,800° K. in color temperature, and development processed according to the following developing steps using various baths containing compounds represented by the general formula (I-a) or (I-b) in an amount shown in Table 1.

| | | |
|---|---|---|
| First developing bath | 6 min | 38° C. |
| Washing with water | 2 min | " |
| Reversing bath | 2 min | " |
| Color-developing bath | 6 min | " |
| Conditioning bath | 2 min | " |
| Bleaching bath | 6 min | " |
| Fixing bath | 4 min | " |
| Washing with water | 4 min | " |
| Stabilizing bath | 1 min | ordinary temperature |
| First Developing Bath | | |
| Water | | 700 ml |

-continued

| | |
|---|---|
| Sodium tetrapolyphosphate | 2 g |
| Sodium sulfite | 20 g |
| Hydroquinone monosulfonate | 30 g |
| Sodium carbonate (monohydrate) | 30 g |
| 1-Phenyl-4-methyl-4-methoxy-3-pyrazolidone | 2 g |
| Potassium bromide | 2.5 g |
| Potassium thiocyanate | 1.2 g |
| Potassium iodide (0.1% solution) | 2 g |
| Water to make | 1,000 ml (pH 10.1) |
| Reversing Bath | |
| Water | 700 ml |
| 6 Na Salt of nitrilo-N,N,N—trimethylenephosphonic acid | 3 g |
| Stannous chloride (dihydrate) | 1 g |
| p-Aminophenol | 0.1 g |
| Sodium hydroxide | 8 g |
| Glacial acetic acid | 15 ml |
| Water to make | 1,000 ml |
| Color Developing Bath | |
| Water | 700 ml |
| Sodium tetrapolyphosphate | 7 g |
| Sodium sulfite | 7 g |
| Sodium tertiary phosphate (12 hydrate) | 36 g |
| Potassium bromide | 1 g |
| Potassium iodide (0.1% solution) | 90 ml |
| Sodium hydroxide | 3 g |
| Citrazinic acid | 1.5 g |
| 4-Amino-3-methyl N—ethyl-β-hydroxyethylaniline sesquisulfate monohydrate | 11 g |
| Ethylenediamine | 3 g |
| Water to make | 1,000 ml |
| Conditioning Bath | |
| Water | 700 ml |
| Sodium sulfite | 12 g |
| Sodium ethylenediaminetetraacetate (dihydrate) | 8 g |
| Glacial acetic acid | 3 ml |
| Water to make | 1,000 ml |
| Bleaching Bath | |
| Water | 800 ml |
| Ethylenediaminetetraacetic acid sodium salt (dihydrate) | 2.0 g |
| Iron (III) ammonium ethylenediamine tetraacetate (dihydrate) | 120.0 g |
| Potassium bromide | 100.0 g |
| Water to make | 1,000 ml |
| Fixing Bath | |
| Water | 800 ml |
| Ammonium thiosulfate | 80.0 g |
| Sodium sulfite | 5.0 g |
| Sodium bisulfite | 5.0 g |
| Water to make | 1,000 ml |
| Stabilizing Bath | |
| Water | 800 ml |
| Formalin (37 wt %) | 5.0 ml |
| Fuji Drywel | 5.0 ml |
| Water to make | 1,000 ml |

The silver amount remaining in the maximum density portion of each film sample having been development processed as described above was measured according to X-ray fluorometric analysis. Results thus-obtained are shown below.

TABLE 1

| Sample | Bleach-Accelerating Agent | Amount Added to Conditioning Bath | Amount of Remaining Ag ($\mu g/cm^2$) |
|---|---|---|---|
| 1 | Not added | — | 50 |
| 2 | Compound (I-b)-(2) | $2 \times 10^{-2}$ mol/l | 3.3 |
| 3 | Compound (I-a)-(1) | " | 5.2 |
| 4 | Compound (I-b)-(17) | " | 4.0 |
| 5 | Compound (I-a)-(19) | " | 6.5 |
| 6 | Compound (I-a)-(25) | " | 8.3 |

As is shown above, films which were processed in a conditioning bath containing the compound of the present invention are freed of silver to such degree that remaining silver does not substantially matter, giving distinct color images.

The compounds of the present invention realized rapid development processing, causing less environmental pollution.

EXAMPLE 2

The same reversal processing as in Example 1 was conducted except for omitting the conditioning bath, providing a bleach-fixing solution of the following formulation in place of both the bleaching solution and the fixing solution, and adding Compound (I-b)-(3) or (I-a)-(12) of the present invention to the bleach-fixing solution (bleach-fixing time: 6 minutes) in an amount shown in Table 2. The amount of silver remaining in the film samples were determined in the same manner as in Example 1. Results thus-obtained are shown in Table 2.

| Bleach-Fixing Bath | |
|---|---|
| Iron (III) ammonium ethylenediaminetetraacetate dihydrate | 120.0 g |
| Disodium ethylenediaminetetraacetate | 5.0 g |
| Ammonium thiosulfate aqueous solution (70%) | 170.0 ml |
| Sodium sulfite | 10.0 g |
| Water to make | 1,000 ml (pH 6.5) |

TABLE 2

| Sample | Bleach-Accelerating Agent | Amount Added to Bleach-Fixing Solution | Amount of Remaining Ag ($\mu g/cm^2$) |
|---|---|---|---|
| 7 | Not added | — | 120 |
| 8 | Compound (I-b)-(3) | $1 \times 10^{-2}$ mol/l | 3.9 |
| 9 | Compound (I-a)-(12) | " | 5.6 |

Table 2 shows that, when added to the bleach-fixing solution, the compounds of the present invention accelerate silver removal to the same degree as when added to a conditioning bath.

EXAMPLE 3

On a cellulose triacetate film support were coated layers having the following compositions to prepare multilayer color negative light-sensitive materials.

Layer-1 Antihalation Layer 40 cc of a 5 wt% aqueous solution of a coating agent, sodium p-dodecylbenzenesulfonate, was added to 1 kg of a black colloidal silver emulsion (containing 15 g of black silver amount and 100 g of gelatin per 1 kg of emulsion), and coated in a dry thickness of 2$\mu$.

Layer-2 Gelatin Interlayer (dry thickness: 1.0$\mu$)

Layer-3 Red-Sensitive, Lower-Sensitivity Silver Halide Emulsion Layer

A silver bromoiodide emulsion containing 5 mol% iodide (mean particle size: 0.3$\mu$; containing 100 g of silver halide and 70 g of gelatin per kg of the emulsion) was prepared in an ordinary manner. 210 cc of a 0.1% methanol solution of a spectrally red-sensitizing agent, anhydro-5,5-dichloro-9-ethyl-3,3'-di(3-sulfopropyl)-thiacarbocyanine hydroxide pyridinium salt, was added to 1 kg of the emulsion. Then, 20 cc of a 5 wt% aqueous solution of 5-methyl-7-hydroxy-2,3,4-triazaindolizine, 400 g of a cyan coupler emulsion (1) of the following formulation, and 200 g of an emulsion (2) of the following formulation were added thereto. Subsequently, 200 cc of a 2% aqueous solution of colored cyan coupler (CC-1) was added thereto, and 30 cc of a 2 wt% aqueous solution of 2-hydroxy-4,6-dichlorotriazine sodium salt was further added thereto as a gelatin hardener. Thus, a red-sensitive, lower-sensitivity silver halide emulsion solution was obtained. This solution was coated in a dry thickness of 3.5$\mu$.

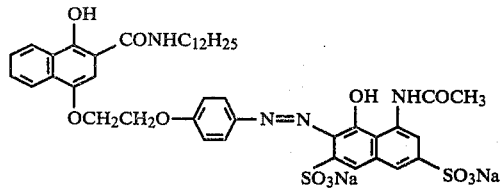

CC-1

| Emulsion (1) | | |
|---|---|---|
| (i) | 10 wt % Gelatin aqueous solution | 1,000 g |
| (ii) | Sodium p-dodecylbenzenesulfonate | 5 g |
| | Tricresyl phosphate | 60 cc |
| | Cyan coupler (C-101) | 70 g |
| | Ethyl acetate | 100 cc |

Mixture (ii) was made into a solution at 55° C. and added to solution (i) previously heated to 55° C., followed by emulsifying the resulting mixture in a colloid mill.

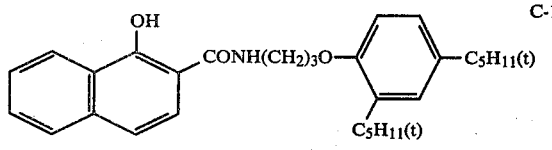

C-101

| Emulsion (2) | | |
|---|---|---|
| (i) | 10 wt % Gelatin aqueous solution | 1,000 g |
| (ii) | Sodium p-dodecylbenzenesulfonate | 5 g |
| | Tricresyl phosphate | 60 cc |
| | Cyan coupler (C-101) | 70 g |
| | DIR compound (D-1) | 10 g |
| | Ethyl acetate | 100 cc |

Mixture (ii) was made into a solution at 55° C. and added to solution (i) previously heated to 55° C., followed by emulsifying the resulting mixture in a colloid mill.

D-1

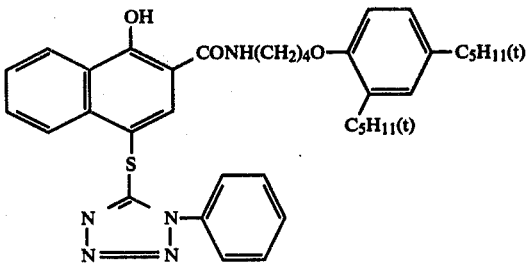

Layer-4 Red-sensitive, Higher-Sensitivity Silver Halide Emulsion Layer

The same formulation of silver halide emulsion as used for layer-3 was employed except for the following alterations.

| | |
|---|---|
| Mean particle size of emulsion | 0.9μ |
| Amount of red-sensitizing agent | 140 cc |
| Emulsion (1) | 220 g |
| Emulsion (2) | 30 g |

The thus-obtained silver-halide solution was coated in a dry thickness of 2.2μ.

Layer-5 Gelatin interlayer (dry thickness: 0.8μ)

Layer-6 Green-Sensitive, Lower-Sensitivity Silver Halide Emulsion Layer

To 1 kg of the same silver bromoiodide emulsion as used in layer-3 were added, in sequence, 180 cc of a 0.1% methanol solution of a green-sensitizing dye, 3,3'-di(2-sulfoethyl)-9-ethylbenzoxacarbocyanine pyridinium salt, and 20 cc of a 5 wt% aqueous solution of 5-methyl-7-hydroxy-2,3,4-triazaindolizine. Then, 320 g of a magenta coupler emulsion (3) of the following formulation and 180 g of an emulsion (4) of the following formulation were added thereto. Further, 50 cc of a 2 wt% aqueous solution of a gelatin hardener, 2-hydroxy-4,6-dichlorotriazine sodium salt, was added thereto to prepare a green-sensitive, lower-sensitivity silver halide emulsion solution. This solution was coated in a dry thickness of 3.2μ.

Layer-7 Green-Sensitive, Higher-Sensitivity Silver Halide Emulsion Layer

The same formulation of silver halide as used for layer-6 was employed except for the following alterations.

| | |
|---|---|
| Mean particle size of emulsion | 1.0 μ |
| Content of iodide in emulsion | 6.5 mol % |
| Amount of added green-sensitizing agent | 100 cc |
| Emulsion (3) | 150 g |
| Emulsion (4) | 30 g |

The thus-obtained silver halide solution was coated in a dry thickness of 2.2μ.

| Emulsion (3) | | |
|---|---|---|
| (i) | 10 wt % Gelatin aqueous solution | 1,000 g |
| (ii) | Sodium p-dodecylbenzenesulfonate | 5 g |
| | Tricresyl phosphate | 80 cc |
| | Magenta coupler (M-101) | 50 g |
| | Colored magenta coupler (CM-1) | 10 g |
| | Ethyl acetate | 120 cc |

Mixture (ii) was made into a solution at 55° C. and added to solution (i) previously heated to 55° C., followed by emulsifying the resulting mixture in a colloid mill.

M-101

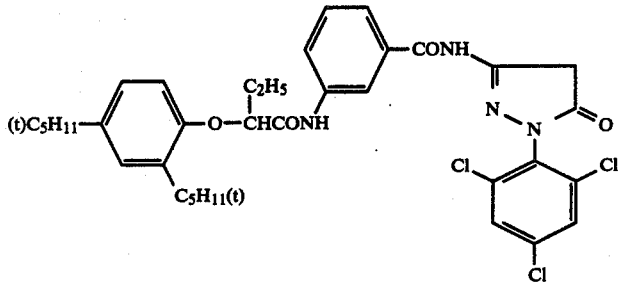

CM-1

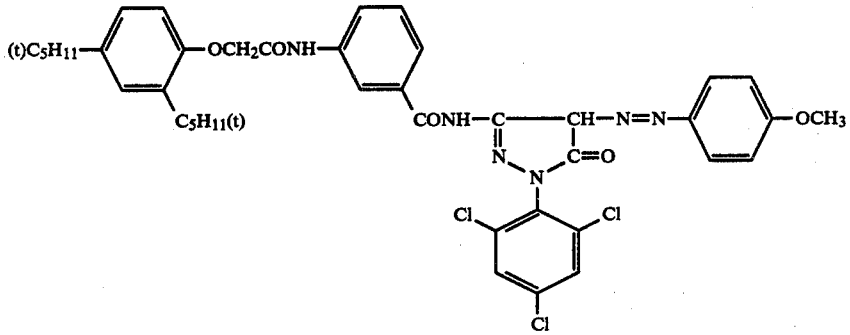

| Emulsion (4) | | |
|---|---|---|
| (i) | 10 wt % Gelatin aqueous solution | 1,000 g |
| (ii) | Sodium p-dodecylbenzenesulfonate | 5 g |
| | Tricresyl phosphate | 80 cc |

-continued

| Emulsion (4) | | |
|---|---|---|
| | Magenta coupler (M-101) | 50 g |
| | Colored magenta coupler (CM-1) | 10 g |
| | DIR compound (D-2) | 15 g |
| | Ethyl acetate | 120 cc |

Mixture (ii) was made into a solution at 55° C. and added to solution (i) previously heated to 55° C., followed by emulsifying the resulting mixture in a colloid mill.

D-2

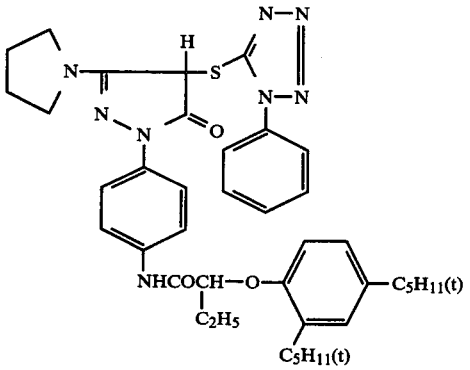

Layer-8 Yellow Colloidal Silver Layer (dry thickness: 1.6μ)

Layer-9 Blue-Sensitive, Lower-Sensitivity Silver Halide Emulsion Layer

To 1 kg of the same silver bromoiodide emulsion as used for layer-3 except for the mean particle size being 0.5μ were added 20 cc of a 5 wt% aqueous solution of 5-methyl-7-hydroxy-2,3,4-triazaindolizine and 1,500 g of a yellow coupler emulsion (5) of the following formulation. Further, 50 cc of a 2 wt% aqueous solution of a gelatin hardener, 2-hydroxy-4,6-dichloro-triazine sodium salt was added thereto to prepare a blue-sensitive, lower-sensitivity silver halide emulsion solution. This solution was coated in a dry thickness of 3.0μ.

| Emulsion (5) | | |
|---|---|---|
| (i) | 10 wt % Gelatin aqueous solution | 1,000 g |
| (ii) | Sodium p-dodecylbenzenesulfonate | 5 g |
| | Tricresyl phosphate | 80 cc |
| | Yellow coupler (Y-1) | 100 g |
| | Ethyl acetate | 120 cc |

Mixture (ii) was made into a solution at 55° C. and added to solution (i) previously heated to 55° C., followed by emulsifying the resulting mixture in a colloid mill.

Y-1

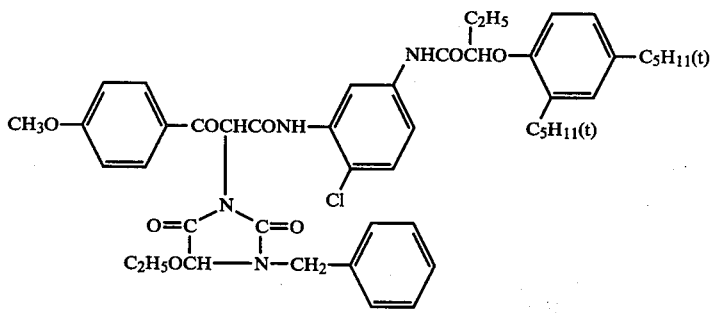

Layer-10 Blue-Sensitive, Higher-Sensitivity Silver Halide Emulsion Layer

The same silver halide emulsion as used for layer-9 except for the following alterations was employed.

| | |
|---|---|
| Mean particle size of emulsion | 1.1μ |
| Emulsion (5) | 300 g |

The thus-obtained silver halide solution was coated in a dry thickness of 2.5μ.

Layer-11 Gelatin Protective Layer (dry thickness: 1.5μ)

The resulting photographic element was exposed in an exposure amount of 25 CMS using a tungsten light source and a filter to adjust color temperature to 4,800° K., then development processed at 38° C. according to the following processing steps.

| | |
|---|---|
| 1. Color development | 3 min and 15 sec |
| 2. Pre-bath | 30 sec |
| 3. Bleaching | 4 min and 20 sec |
| 4. Fixing | 4 min and 20 sec |
| 5. Washing | 3 min and 15 sec |
| 6. Stabilization | 30 sec |

Composition of each processing solution used in the above-described processing is as follows.

| | |
|---|---|
| Coloring Developing Solution | |
| Trisodium nitrilotriacetate | 1.9 g |
| Sodium sulfite | 4.0 g |
| Potassium carbonate | 30.0 g |
| Potassium bromide | 1.4 g |
| Potassium iodide | 1.3 mg |
| Hydroxylamine sulfate | 2.4 g |
| 4-(N—Ethyl-N—β-hydroxyethylamino)-2-methylaniline sulfate | 4.5 g |
| Water to make | 1 l |
| | pH 10.0 |
| Bleaching Solution | |
| Iron (III) ammonium ethylenediamine-tetraacetate | 100.0 g |
| Disodium ethylenediaminetetraacetate | 8.0 g |
| Ammonium bromide | 150.0 g |
| Water to make | 1.0 l |
| | pH 6.0 |
| Fixing Solution | |
| Sodium tetrapolyphosphate | 2.0 g |
| Sodium sulfite | 4.0 g |
| Ammonium thiosulfate aqueous solution (70%) | 175.0 ml |

-continued

| | |
|---|---|
| Sodium bisulfite | 4.6 g |
| Water to make | 1.0 l |
| | pH 6.6 |
| Stabilizing Solution | |
| Formalin (40%) | 8.0 ml |
| Water to make | 1.0 l |
| Pre-Bath | |
| Glacial acetic acid | 10.0 ml |
| Sodium sulfite | 12.0 g |
| Compound of the invention (given in Table 3) | amount given in Table 3 |
| Water to make | 1.0 l |
| (pH was adjusted to 5-6 with NaOH) | |

Aside from the above-described processing, the above-described development processing was conducted except for using the same pre-bath as described above except for not contaning the compound of the present invention.

Each film sample having been development processed in the above-described manner was subjected to X-ray fluorometric analysis to determine the silver amount remaining in the maximum density portion of the sample. Results thus-obtained are shown in Table 3.

TABLE 3

| Sample | Bleach-Accelerating Agent | Amount Added to Pre-Bath | Amount of Remaining Ag ($\mu g/cm^2$) |
|---|---|---|---|
| 10 | Not added | — | 18.5 |
| 11 | Compound (I-a)-(11) | $2 \times 10^{-2}$ mol/l) | 0.8 |
| 12 | Compound (I-b)-(16) | " | 2.2 |
| 13 | Compound (I-a)-(29) | " | 3.7 |

Table 3 shows that samples 11 to 13 processed using the compound of the present invention underwent remarkably accelerated removal of silver in comparison with comparative sample 10 processed without the compound of the present invention. In addition, when bleaching and fixing after pre-bath processing were conducted not separately but simultaneously in a combined bath of bleach-fixing solution to be described in Example 4, processing using a pre-bath containing the compound of the present invention provided the same desirable results as shown in Table 3.

EXAMPLE 4

The same processing as in Example 3 was conducted except for omitting the pre-bath, providing a bleach-fixing solution in place of the bleaching solution and the fixing solution, and adding the compound of the present invention (given in Table 4) to the bleach-fixing solution. (Bleach-fixing time was 3 minutes and 15 seconds). The silver amount remaining in the film was determined in the same manner as in Example 3. Results thus-obtained are shown in Table 4.

| Bleach-Fixing Solution | |
|---|---|
| Iron (III) ammonium ethylenediamine-tetraacetate dihydrate | 100.0 g |
| Disodium ethylenediaminetetraacetate dihydrate | 5.0 g |
| Sodium sulfite | 10.0 g |
| Ammonium thiosulfate aqueous solution (70%) | 170.0 ml |
| Water to make | 1.0 l |

-continued

| Bleach-Fixing Solution | |
|---|---|
| | pH 6.9 |

TABLE 4

| Sample | Bleach-Accelerating Agent | Amount Added to Blix Solution | Amount of Remaining Ag ($\mu g/cm^2$) |
|---|---|---|---|
| 14 | Not added | — | 85.0 |
| 15 | Compound (I-b)-(2) | $2 \times 10^{-2}$ mol/l | 1.2 |
| 16 | Compound (I-a)-(5) | " | 4.2 |
| 17 | Compound (I-a)-(15) | - | 5.7 |
| 18 | Compound (I-b)-(16) | " | 2.3 |
| 19 | Compound (I-a)-(18) | " | 8.9 |
| 20 | Compound (I-a)-(27) | " | 7.7 |
| 21 | Thiourea | " | 71.4 |
| 22 | $(CH_3)_2NCH_2CH_2S-C(=S)NHCH_3$* | " | 25.5 |

*Compound described in Japanese Patent Application (OPI) No. 26506/80

Table 4 shows that the use of the compound of the present invention (samples 15 to 20) remarkably accelerated removal of silver as compared to the use of known compound thiourea and the compound for sample 22 outside the scope of the present invention (Samples 21 and 22), thus making it possible to rapidly bleach-fix higher-sensitivity negative light-sensitive materials.

In addition, dye images obtained by bleach-fixing using the compound of the present invention, (I-b)-(2) or (I-a)-(5), were found to be by no means inferior to that obtained by Fuji Color Process CN-16 processing (Fuji Photo Film Co., Ltd.)(color development: 3 min and 15 sec; bleaching: 6 min and 30 sec; washing: 2 min and 10 sec; fixing: 4 min and 20 sec; washing: 3 min and 15 sec; stabilizing: 1 min and 5 sec; drying; processing temperature of each processing: 38.0±0.2° C.) in photographic properties such as color density, linear properties of characteristic curve, etc., and show good dye stability.

Then, bleach-fixing solution samples containing (I-b)-(2) or (I-a)(18) were left for 2 weeks in a 40° C. thermostatic chamber to check for formation of a precipitate and deterioration of bleaching power. As a result, no troubles were found. Thus, the bleach-fixing solution containing the compound of the present invention demonstrates excellent properties as a bleach-fixing solution.

EXAMPLE 5

The same processing as described in Example 3 was conducted except for omitting the pre-bath and adding a compound of the present invention to the bleaching solution to determine the amount of silver remaining in film samples. Results thus-obtained are shown in Table 5.

TABLE 5

| Sample | Bleach-Accelerating Agent | Amount Added to Bleaching Solution | Amount of Remaining Silver ($\mu g/cm^2$) |
|---|---|---|---|
| 23 | Not added | — | 19.0 |
| 24 | Compound (I-b)-(3) | $2\ 10^{-2}$ mol/l | 2.2 |

TABLE 5-continued

| Sample | Bleach-Accelerating Agent | Amount Added to Bleaching Solution | Amount of Remaining Silver ($\mu g/cm^2$) |
|---|---|---|---|
| 25 | Compound (I-a)-(12) | " | 4.8 |
| 26 | Compound (I-b)-(17) | " | 3.6 |

Table 5 shows that addition of the compound of the present invention to a bleaching solution also makes it possible to obtain remarkably accelerated removal of silver.

While the invention has been described in detail and with reference to specific embodiments thereof, it will be apparent to one skilled in the art that various changes and modifications can be made therein without departing from the spirit and scope thereof.

What is claimed is:

1. A method for processing a color photographic light-sensitive material by subjecting an exposed silver halide color photographic light-sensitive material to a color development processing then to a bleaching processing and a fixing processing or to a bleach-fixing processing, which process comprises incorporating at least one compound represented by the following general formula (I-a) or (I-b) in a bath of said bleaching or bleach-fixing processing or in a pre-bath thereof:

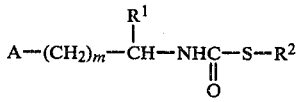

(I-a)

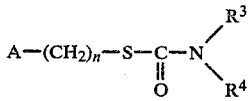

(I-b)

wherein A represents an amino group which is optionally substituted or a nitrogen-containing hetero ring residue which may be optionally substituted, $R^1$ represents a hydrogen atom or a carboxy group, $R^2$ represents a monovalent metal atom, an ammonium group, an optionally substituted alkyl group or a group represented by

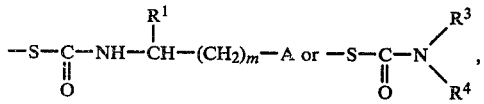

$R^3$ and $R^4$ each represents a hydrogen atom or an alkyl group which may be substituted by a hydroxy group, an alkoxy group, a halogen atom, a carboxyl group, $-SO_2H$, $-SO_3H$, or a group represented by A described above, m represents 1 or 2, and n represents an integer of 2 to 4.

2. A method for processing a color photographic light-sensitive material as claimed in claim 1, wherein the substituent of the amino group or a nitrogen containing hetero ring residue represented by A is an alkyl group which contains 1 to 3 carbon atoms and may be substituted.

3. A method for processing a color photographic light-sensitive material as claimed in claim 1, wherein $R^2$, $R^3$ and $R^4$ represent an alkyl group containing 1 to 5 carbon atoms.

4. A method for processing a color photographic light-sensitive material as claimed in claim 1, wherein the amount of the compound in a bleaching bath, a bleach-fixing bath or a pre-bath thereof is $1\times10^{-5}$ to 1 mol/liter of a processing solution.

5. A method for processing a color photographic light-sensitive material as claimed in claim 1, wherein a bleaching agent used in a bleaching bath or bleach-fixing bath is a persulfate.

6. A method for processing a color photographic light-sensitive material as claimed in claim 1, wherein a bleaching agent used in a bleaching bath or bleach-fixing bath is a ferric ion complex salt.

* * * * *